US007106875B2

(12) United States Patent
King

(10) Patent No.: US 7,106,875 B2
(45) Date of Patent: Sep. 12, 2006

(54) DUAL BOUNDARY PRESSURE ZONE THREE DIMENSIONAL MICROPHONE AND HEARING AID

(76) Inventor: James T. King, 43 Granada Ct., Silver Cliff, CO (US) 81252

( * ) Notice: Subject to any disclaimer, the term of this patent is extended or adjusted under 35 U.S.C. 154(b) by 80 days.

(21) Appl. No.: 10/657,945

(22) Filed: Sep. 9, 2003

(65) Prior Publication Data

US 2005/0053251 A1 Mar. 10, 2005

(51) Int. Cl.
*H04R 25/00* (2006.01)

(52) U.S. Cl. ..... 381/359; 381/355

(58) Field of Classification Search ..... 381/322, 381/324–325, 328, 330, 355, 356–358, 359–360, 381/380–381; 379/369, 433
See application file for complete search history.

(56) References Cited

U.S. PATENT DOCUMENTS 3,983,336 A * 9/1976 Malek et al. ..... 381/313
4,051,330 A * 9/1977 Cole ..... 381/313
4,361,736 A 11/1982 Long et al.
5,168,525 A 12/1992 Muller
5,410,608 A * 4/1995 Lucey et al. ..... 381/360
6,158,902 A 12/2000 Staat
6,408,080 B1 6/2002 Koizumi

* cited by examiner

*Primary Examiner*—Suhan Ni
*Assistant Examiner*—Phylesha Dabney
(74) *Attorney, Agent, or Firm*—Myers & Kaplan, LLC; Greg O'Bradovich, Esq.; Barry E. Kaplan, Esq.

(57) ABSTRACT

In general, a three dimensional microphone and a three dimensional hearing aid is described. The microphone and hearing aid typically have two boundaries that contribute to the increased frequency response and three dimensional response of the microphone. A microphone element is oriented in and flush with the first boundary which is typically the forward face of a hearing aid. A second boundary, which is typically a boundary button is oriented above and generally parallel with the microphone element creating an overall improvement in frequency response.

14 Claims, 2 Drawing Sheets

DUAL BOUNDARY PRESSURE ZONE THREE DIMENSIONAL MICROPHONE AND HEARING AID

BACKGROUND

I. Field of the Invention

The present invention relates generally to the field of acoustics, and more particularly, to a three dimensional microphone apparatus and system and a three dimensional hearing aid.

II. Description of the Related Art.

FIG. 1 illustrates a perspective view of a prior art "In The Ear" (ITE) hearing aid 100. This typical hearing aid 100 includes a central body 105 having a general shape that is adapted to fit into a user's ear canal. The rear-most portion 110 is adapted to fit into the canal closest to the ear drum and includes a speaker 115. The forward-most portion 120 typically protrudes or is flush with the opening of the user's ear. The forward-most portion 120 includes a face 125 that includes operational features of the hearing aid 100. These features include a microphone element 130 that is adapted to receive acoustical spectra (sounds) from the environment. The microphone element 130 is typically placed underneath the surface of the face 125 flush with the outer surface shell and an opening 135 allows the sounds to enter to the microphone element 130. In general, the microphone element 130 is of the type having a microphone membrane facing outward from the hearing aid. The other operational features of the hearing aid 100 typically include a battery door 140 behind which a battery (not shown) can be placed to operate the inner electronics (not shown) of the hearing aid 100. These electronics typically process and amplify the received sound for transmission to the speaker 115 so that a user can hear the received sounds. The operational features further include a volume control 145 and a micro-handle 150 so that the user can easily place and remove the hearing aid with the use of finger tips. It is understood that there are many different variations in the type of hearing aids presently available. The hearing aid 100 is shown for illustrative purposes.

Microphone elements 130 in typical hearing aids such as hearing aid 100 suffer from several disadvantages. These disadvantages primarily include pre-eminence and proximity effects. In general, human hearing is three dimensional. Typical listeners with normal hearing can discern the location of several sounds and can also discriminate between sounds when there are a large number of sounds in a given area. However, with a typical hearing aid, pre-eminence is the effect in which the loudest sound near the microphone element in the hearing aid is the dominant sound, drowning out other sounds, particularly those sounds farther away from the microphone element. Sounds are therefore positioned by loudness and frequency so that the listener can not discern how far apart different sounds are from one another. In essence, sound becomes two-dimensional instead of three-dimensional.

Another disadvantage to microphone elements 130 in typical hearing aids is proximity effects. A typical proximity effect occurs when the microphone element is brought near a reflective boundary, for example, a telephone handset. The proximity effect affects the frequency response of the microphone element in the hearing aid thereby creating phase problems and potential feedback in the system.

In general, another disadvantage of modern hearing aids is that they include microphone elements that have a cardioid pattern. A cardioid pick-up pattern can only pick up sounds most efficiently when they are directly perpendicular to the microphone. The more a sound source moves away from a direct path, the more the microphone loses the ability to pick up that sound.

A further disadvantage of typical hearing aids is that background noise appears to have the same dominance as desired target sounds.

Still another disadvantage with a typical hearing aid is that the microphone element is mounted underneath the face (see 125 above) of the hearing aid and is provided a small opening (see 135 above). Therefore, the membrane has a diameter larger than the opening. This orientation of the microphone element further detrimentally effects the frequency response of the hearing aid. Since hearing aid transducers are small, the frequency response is detrimentally affected.

Many of these disadvantages are due to the microphone technology utilized in the hearing aids. In order to overcome the disadvantages of microphones, several approaches have been taken. For example, U.S. Pat. No. 4,361,736 provided a process and apparatus transducing acoustical signals without discrimination between direct and random incidence acoustical variations of the sound being transduced., typically within a desired frequency range. These advantages are attained by affixing a boundary in front of a microphone element, thereby creating a pressure zone between the boundary and the microphone element. The process and apparatus helped reduce or eliminate the discrimination between the frequency spectra of direct and random incidence sound waves in a frequency of interest and the lack of the ability to reject undesired high frequencies that can cause unwanted pressure build-up at the microphone, among other problems. This frequency range could be mechanically determined by the spacing between a boundary and an acoustically isolated microphone element, which determined high frequency cut-off, and the size of the boundary, which determined low frequency cut-off.

Other technologies using "boundary layer" microphones typically provide a large boundary in which a microphone element is mounted within and flush with the boundary. In theory, the sound waves (typically the perpendicular components) incident on the boundary are superimposed in phase thereby essentially doubling the acoustical pressure which increases the sensitivity, typically by 6 dB, of the microphone mounted on the boundary. The doubling of the acoustic pressure typically occurs best where the boundary surface is large compared to the wave length of the sound waves.

The problems with these associated technologies results from the fact that large boundaries are needed to obtain good low frequency response. Furthermore, many microphone technologies to improve frequency response are not utilized in hearing aids due to the miniaturization problem.

SUMMARY

In general, a three dimensional microphone typically for use in a hearing aid is described. The microphone and hearing aid typically have two boundaries that contribute to the increased frequency response and three dimensional response of the microphone. A microphone element is oriented in and flush with the first boundary which is typically the forward face of a hearing aid. This first boundary arrangement creates a desired overall improvement in frequency response. A second boundary, which is typically a boundary button is oriented above and generally parallel with the microphone element. Due to the inherent miniaturization of the hearing aid, the boundary button is large relative to the microphone creating a desired pressure zone effect. The two boundaries combine, increasing the total boundary area and the desired effect of the three dimensional microphone.

In general, in one aspect, the invention features a hearing aid, including a main body having a forward end and a rear end, a forward face having an upper surface, a speaker oriented in the rear end, a microphone element oriented in the forward face and a boundary button connected to the forward face and oriented over and generally parallel to the microphone.

In one implementation, the hearing aid further includes legs connected between a lower surface of the boundary button and the upper surface of the forward face.

In another implementation, the hearing aid further includes a space formed between the forward face and the boundary button, the width of the space generally being defined by the length of the legs.

In another implementation, the space is a pressure zone.

In another implementation, the microphone element has a diameter and the boundary has a diameter.

In still another implementation, the diameter of the boundary button is larger than the diameter of the microphone element.

In yet another implementation, the diameter of the boundary button is twice the diameter of the microphone element.

In another implementation, the forward end of the microphone element is oriented flush with the upper surface of the forward face.

In another aspect, the invention features a microphone, including a first boundary having a first surface, a microphone pressure membrane oriented in the boundary generally flush with the first surface and a second boundary generally parallel to the first boundary, the second boundary being oriented directly in front of the membrane and parallel to the membrane.

In one implementation, the microphone further includes legs connected between the first surface and the second boundary.

In another implementation, the legs space the first and second boundaries to create a high frequency cut-off of the microphone.

In another implementation, the first boundary has a diameter greater than the diameter of the second boundary.

In another implementation, the second boundary has a diameter greater than the diameter of the membrane.

In another implementation, the diameter of the first boundary creates a low frequency cut-off.

In another implementation, the diameter of the second boundary creates a low frequency cut-off.

In another implementation, the area of the first boundary and the area of the second boundary have an effective combined area that enhance the hemispherical pick-up pattern of the microphone.

In another aspect, the invention features a hearing aid kit, including a hearing aid having a forward face and a microphone oriented in the forward face and a boundary button adapted to be connected to the forward face In one implementation, the forward face is a first boundary, the microphone being positioned in the first boundary flush to the first boundary.

In another implementation, the boundary button is a second boundary, the second boundary being adapted to create a pressure zone between the microphone and the second boundary when the boundary button is mounted on the forward face.

In another implementation, the distance between the microphone and the boundary button determines the high frequency cut off of the microphone.

In another implementation, the relationship of the diameters of the boundary button and the microphone determine the low frequency cutoff of the microphone One advantage of the invention is that proximity and pre-eminence effects are reduced or eliminated.

Another advantage of the invention is that the boundary button present on the hearing aid creates a 6 dB boost in gain.

Another advantage of the invention is that a good high frequency response is attained which is advantageous to most users with hearing loss, which typically occurs at the higher frequency range of hearing.

Another advantage of the invention is that the better gain attained with the presence of the boundary button results in greater battery life because the gain in the internal electronics can be lowered.

Another advantage is that a hemispherical microphone pattern is created so that closer to true natural three dimensional hearing is attained.

Another advantage of the invention is that the naturally detrimentally affected frequency response of the small microphone of the hearing aid is improved by the improvement of the frequency response of the flush microphone orientation and the presence of the boundary button.

Other objects, advantages and capabilities of the invention will become apparent from the following description taken in conjunction with the accompanying drawings showing the preferred embodiment of the invention.

DETAILED DESCRIPTION

Figure 1:
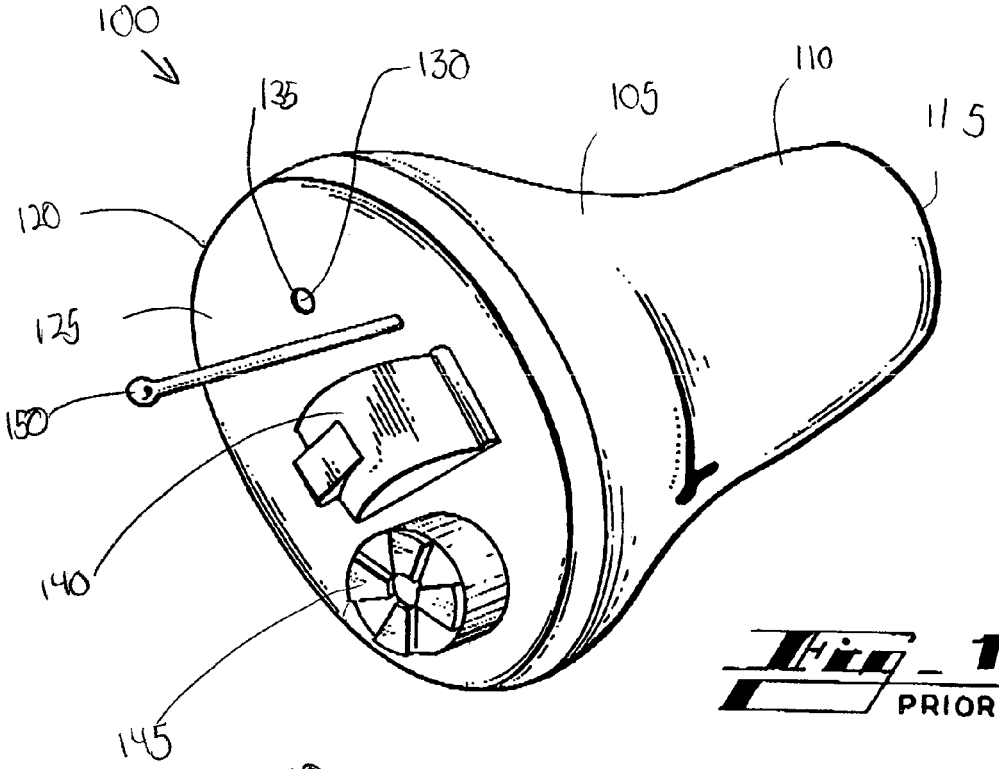
Fig 1 PRIOR ART
FIG. 1 illustrates a perspective view of a prior art "In The Ear" (ITE) hearing aid.
Figure 2:
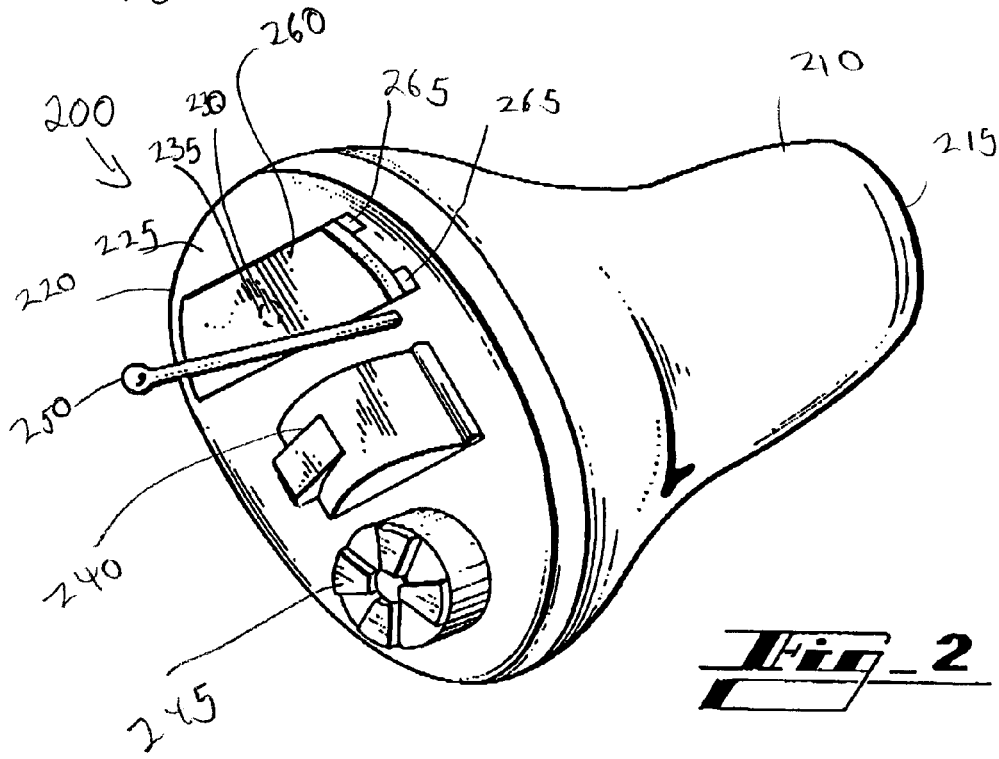
FIG. 2 illustrates an embodiment of a three dimensional hearing aid.

Referring to the drawings wherein like reference numerals designate corresponding parts throughout the several figures, reference is made first to FIG. 2 that illustrates an embodiment of a three dimensional hearing aid 200.

The hearing aid 200 shown exemplifies a hearing aid much like a prior art hearing aid to the extent of including a central body 205 having a general shape that is adapted to fit into a user's ear canal, a rear-most portion 210 having a speaker 215, a forward-most portion 220 including a face 225 having operational features of the hearing aid 200. These features include a microphone element 230, a battery door 240, a volume control 245 and a micro-handle 250. The microphone element 230 is typically placed underneath the surface of the face 225 (and can typically be flush the upper surface of the face 225) and an opening 235 the same diameter of the microphone element 230, which allows the sounds to enter to the microphone element 230. In general, the microphone element is of the type having a microphone membrane facing outward from the hearing aid 200. A boundary button 260 is added to the hearing aid forming the hearing aid 200. In this embodiment of the hearing aid 200, the boundary button 260 has been retrofitted to a presently available hearing aid as part of a kit, providing improvements over prior art hearing aids. Furthermore, as is fully appreciated in the discussed below, the positioning of the microphone element on the hearing aid with respect to the button boundary 260 results in a hearing aid system with further improvements over prior art hearing aids.

The boundary button 260 is typically positioned generally parallel with and over the microphone 130 and microphone opening 135. The boundary button 260 includes several legs 265 to raise the boundary button a height over the microphone element 230.

Figure 3:
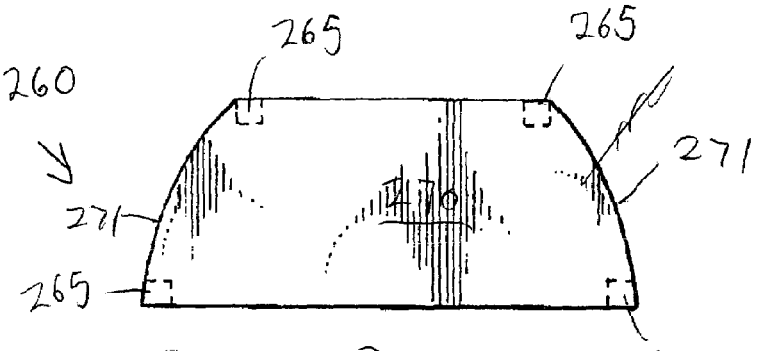
FIG. 3 illustrates a top view of an embodiment of a boundary button.

FIG. 3 illustrates a top view of an embodiment of the boundary button 260 of FIG. 2. The boundary button 260 typically includes a main body 270 having an upper and lower surface and legs 265. Generally, the main body 270 can have a variety of shapes. A generally four-sided shape having curved sides 271 is shown. This particular shape is used to generally mimic the contours of the hearing aid 200 as shown in FIG. 2 above.

Figure 4:
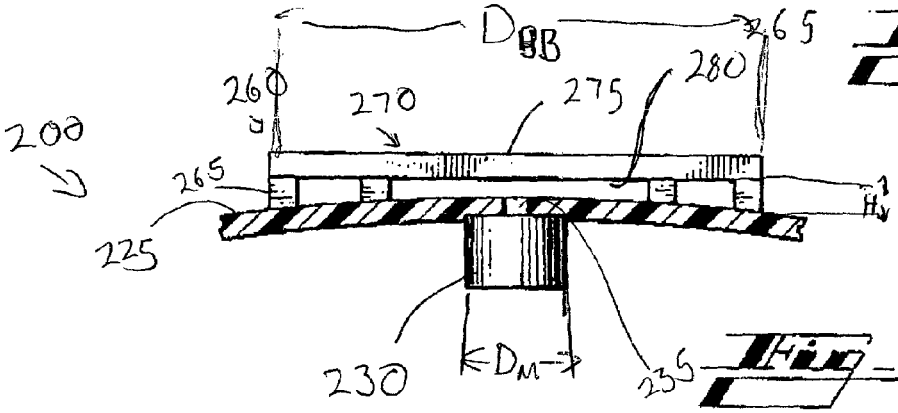
FIG. 4 illustrates a partial cut away side view of an embodiment of a three dimensional hearing aid.

FIG. 4 illustrates a partial cut away side view of an embodiment of a three dimensional hearing aid 200. Once again, a kit-type configuration is shown in which a boundary button 260 has been retrofitted onto a presently available hearing aid to create the three-dimensional hearing aid 200. In general, the boundary button 260 can be fitted onto the fact 225 with any suitable adhesive.

The boundary button 260 includes one or more legs 265 between the face 225 and the main body 270. The legs 265 are typically connected to the lower surface 280 of the body 270. The body 270 further includes an upper surface 275. FIG. 4 illustrates the face 225 as having an overall curvature that varies the distance H between the lower surface 280 and the face 225. In a typical hearing aid, the face includes this curvature. Therefore, hearing aids retrofitted with the boundary button include this varying H. Typically, the value H is adjusted in order to adjust the high frequency cut-off. In general, the greater the distance H, the higher the high frequency cut-off. Therefore, the high frequency cut-off of the hearing aid 200 can be adjusted by adjusting the distance H. As described further below, in a hearing aid having an integral boundary button, the distance H is fixed across the face so that the high frequency cutoff is predictable. In general, it is desirable to adjust the height H so that the highest range of the human hearing spectrum be included within the cut-off since many hearing impaired people are impaired in the upper range. The low frequency cut-off is determined by the diameter $D_{BB}$ of the boundary button 260 with respect to the diameter $D_M$ of the microphone element 230. In general, the larger the diameter $D_{BB}$ of the boundary button 260, the lower the low frequency cut-off. Due to the miniaturization of the boundary button $D_{BB}$ 260 necessary for use in hearing aids, the diameter $D_{BB}$ of the boundary button 260 is typically not large with respect to diameter $D_M$ of the microphone element. Therefore, the low frequency cutoff for the hearing aid 200 can be high. However, since most hearing impaired people having hearing loss in the high frequency range, a high low frequency cut-off is acceptable for the hearing aid 200. In a typical embodiment, the diameter $D_{BB}$ of the boundary button 260 can be twice the diameter $D_M$ of the microphone element. However, in other embodiments, the diameter $D_{BB}$ of the boundary button 260 can be made larger if a lower cutoff for the low frequency response is desired. In addition the boundary created by the microphone element 230 being flush with the upper surface of the face 225 of the central body 205 of the hearing aid 200 adds to the total boundary effect, thereby extending control of the low frequency cutoff.

Furthermore, in this retrofitted kit arrangement, the microphone element 230 is below the surface of the face 225, exposed through opening 235. In a hearing aid having an integral boundary button, the position of the microphone element is also adjusted. In a typical embodiment, the forward end of the microphone element is oriented so that it is flush with the forward face of the hearing aid.

Figure 5:
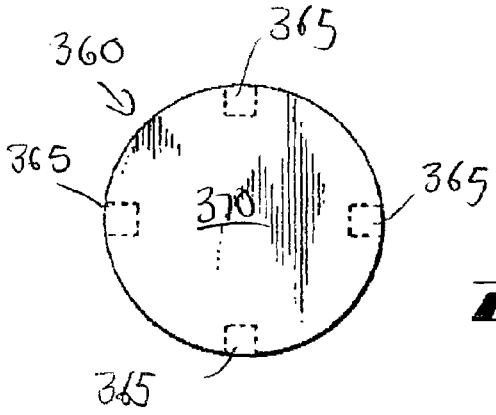
FIG. 5 illustrates an alternate embodiment of a boundary button.

FIG. 5 illustrates an alternate embodiment of a boundary button 360. The boundary button 360 typically includes a main body 370 having an upper and lower surface and legs 365. As described above, the main body 370 can have a variety of shapes. Here, a generally circular shape is shown, which can better be oriented with respect to a microphone element also having a circular shape.

Figure 6:
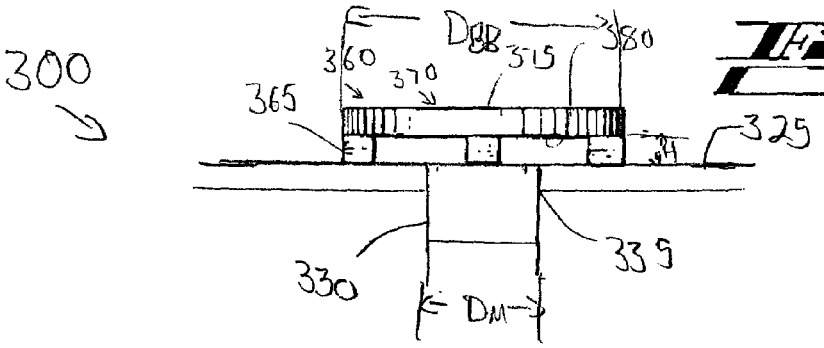
FIG. 6 illustrates a partial cut away side view of another embodiment of a three dimensional hearing aid.

FIG. 6 illustrates a partial cut away side view of another embodiment of a three dimensional hearing aid 300. This hearing aid 300 includes an integral boundary button 360 as shown in FIG. 5 as well as further features.

The boundary button 360 includes one or more legs 365 between the face 325 and the main body 370. The legs 365 are typically connected to the lower surface 380 of the body 370. The body 370 further includes an upper surface 375. One feature of the hearing aid 300 is that it includes a generally flat forward face 325 that allows a generally consistent H between the lower surface 380 and the face 325. As described above, the value H is adjusted in order to adjust the high frequency cut-off, which can be predictable due to a uniform H. As described above, it is desirable to adjust the height H so that the highest range of the human hearing spectrum be included within the cut-off since many hearing impaired people are impaired in the upper range. Similar to the kit embodiment described above, the low frequency cut-off is determined by the diameter $D_{BB}$ of the boundary button 360 with respect to the diameter $D_M$ of the microphone element 330. In general, the larger the diameter $D_{BB}$ of the boundary button 360, the lower the low frequency cut-off. Due to the miniaturization of the boundary button $D_{BB}$ 360 necessary for use in hearing aids, the diameter $D_{BB}$ of the boundary button 360 is typically not large with respect to diameter $D_M$ of the microphone element. Therefore, the low frequency cutoff for the hearing aid 300 can be high. However, since most hearing impaired people having hearing loss in the high frequency range, a high low frequency cut-off is acceptable for the hearing aid 300. In a typical embodiment, the diameter $D_{BB}$ of the boundary button 360 can be twice the diameter $D_M$ of the microphone element. However, in other embodiments, the diameter $D_{BB}$ of the boundary button 360 can be made larger if a lower cutoff for the low frequency response is desired.

Another feature of the hearing aid 300 is that the microphone element 330 is flush with the surface of the face 325 where the opening 335 is taken up entirely by the microphone element 330. In this hearing aid 300 having the integral boundary button 360, and flush microphone element 330 improved frequency response and greater acoustical isolation is realized by having a boundary created by the forward face 325 of the hearing aid 300 and a pressure zone created by the boundary button 360.

In essence, two boundaries are created in this orientation creating a three dimensional microphone. The first boundary is created by the presence of the boundary button, allowing a pressure zone to be created between the boundary button and the microphone element. Furthermore, a second boundary is created by the presence of the microphone element being oriented flush to the face of the hearing aid. The face of the hearing aid therefore becomes the second boundary. Conventional boundary microphones allow both the direct and incident sound waves to enter the microphone element causing undesirable effects similar to the undesirable effects of modern hearing aids. Conventional pressure recording microphones allow only the incident sound waves to enter the microphone element in the pressure zone, but typically has large dimensions. In the hearing aid embodiments described above, the microphone element is oriented flush to the second boundary and the first boundary is oriented above the microphone element thereby creating a pressure zone. However, while the miniaturized boundary button does provide a large boundary with respect to the microphone element to create a pressure zone, it also creates greater acoustical isolation from direct sound waves, while providing a smaller reflective boundary with respect to the overall hearing aid.

The two boundaries contribute to the increased frequency response and three dimensional response of the microphone. The first boundary arrangement creates a desired overall improvement in frequency response. The second boundary, which is typically the boundary button, is large relative to the microphone creating a desired pressure zone effect. The two boundaries combine, increasing the total boundary area and the desired effect of the three dimensional microphone.

In general, the embodiments of the boundary button positioned on a hearing aid as described above provide a boundary that allows only direct sound waves to cross over the microphone element. Other sound energy is reflected away by the boundary. This orientation approximates the way that the human ear operates. By reflecting the incident sound energy away, the hearer now hears sounds in their proper, more natural, perspective, which is three dimensionally with a hemispherical pick up pattern.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A hearing aid, comprising:

a main hearing aid body having a forward end and a rear end;

a forward face having an upper surface;

a speaker oriented in the rear end;

a microphone element oriented flush with the forward face, thereby placing the microphone in a boundary mode; and a boundary button connected to the forward face and oriented over and generally parallel to the microphone, thereby creating a pressure zone between the boundary button and the microphone, wherein the microphone element has a diameter and the boundary button has a diameter, and wherein an area of the forward face and an area of the boundary button have an effective combined area that enhances the hemispherical three dimensional pick-up pattern of the microphone.

2. The hearing aid as claimed in claim 1 further comprising legs connected between a lower surface of the boundary button and the upper surface of the forward face.

3. The hearing aid as claimed in claim 2 further comprising a space formed between the forward face and the boundary button, the width of the space generally being defined by the length of the legs.

4. The hearing aid as claimed in claim 3 wherein the space is a pressure zone.

5. The hearing aid as claimed in claim 1 wherein the diameter of the boundary button is larger than the diameter of the microphone element.

6. The hearing aid as claimed in claim 5 wherein the diameter of the boundary button is twice the diameter of the microphone element.

7. The hearing aid as claimed in claim 1 wherein the forward end of the microphone element is oriented flush with the upper surface of the forward face.

8. A hearing aid microphone, comprising:

a first hearing aid microphone boundary having a first surface:

a microphone pressure membrane oriented in the boundary generally flush with the first surface; and a second hearing aid microphone boundary generally parallel to the first boundary the second boundary being oriented directly in front of the membrane and parallel to the membrane;

wherein the first boundary has a diameter greater than a diameter of the second boundary;

wherein an area of the first boundary and an area of the second boundary have an effective combined area that enhances the hemispherical three dimensional pick-up pattern of the microphone.

9. The microphone as claimed in claim 8 further comprising legs connected between the first surface and the second boundary.

10. The microphone as claimed in claim 9 wherein the legs space the first and second boundaries to create a high frequency cut-off of the microphone.

11. The microphone as claimed in claim 8 wherein the second boundary has a diameter greater than the diameter of the membrane.

12. The microphone as claimed in claim 8 wherein the diameter of the first boundary creates a low frequency cut-off.

13. The microphone as claimed in claim 8 wherein the diameter of the second boundary creates a low frequency cut-off.

14. A hearing aid kit, comprising:

a hearing aid having a forward face and a microphone oriented in the forward face; and a boundary button adapted to be connected to the forward face, wherein the forward face is a first boundary, the microphone being positioned in the first boundary flush to the first boundary, thereby placing the microphone in a boundary mode, wherein the boundary button is a second boundary, the second boundary being adapted to create a pressure zone between the microphone and the second boundary when the boundary button is mounted on the forward face, wherein the distance between the microphone and the boundary button determines the high frequency cut off of the microphone, wherein the relationship of the diameters of the boundary button and the microphone determine the low frequency cutoff of the microphone and wherein an area of the first boundary and an area of the second boundary have an effective combined area that enhances the hemispherical three dimensional pick-up pattern of the microphone.

* * * * *